US005199365A

United States Patent [19]

Arnold

[11] Patent Number: 5,199,365

[45] Date of Patent: Apr. 6, 1993

[54] SEWING MACHINE THREAD MONITORING SYSTEM

[75] Inventor: Kurt Arnold, Kaiserslautern, Fed. Rep. of Germany

[73] Assignee: PFAFF Industriemaschinen GmbH, Kaiserslautern, Fed. Rep. of Germany

[21] Appl. No.: 634,145

[22] PCT Filed: Apr. 28, 1989

[86] PCT No.: PCT/EP89/00472

§ 371 Date: Jan. 9, 1991

§ 102(e) Date: Jan. 9, 1991

[87] PCT Pub. No.: WO89/12124

PCT Pub. Date: Dec. 14, 1989

[30] Foreign Application Priority Data

Jun. 1, 1988 [DE] Fed. Rep. of Germany ..... 3818663

[51] Int. Cl.[5] ..... D05B 69/36

[52] U.S. Cl. ..... 112/273

[58] Field of Search ..... 112/273, 278, 275, 277; 19/0.2, 0.21, 0.25; 28/187; 139/353; 242/37 R; 200/61.18

[56] References Cited

U.S. PATENT DOCUMENTS

| | | | |
|---|---|---|---|
| 4,192,243 | 3/1980 | Blessing et al. | 112/273 |
| 4,196,685 | 4/1980 | Tamura | 112/278 X |
| 4,284,020 | 8/1981 | Conner, Jr. et al. | 112/273 |
| 4,426,948 | 1/1984 | Olasz et al. | 112/273 |
| 4,429,651 | 2/1984 | Tajima | 112/273 |
| 4,602,582 | 7/1986 | Rawson | 112/273 X |
| 5,018,465 | 5/1991 | Hager et al. | 112/273 |

*Primary Examiner*—Peter Nerbun
*Attorney, Agent, or Firm*—McGlew and Tuttle

[57] ABSTRACT

A thread monitoring arrangement for monitoring sewing thread at different areas along the path of the thread inducing a switching process for signalling or stopping the sewing process upon the occurrence of thread disturbance. The thread monitoring arrangement includes first sensor units positioned in an area between a thread reserve and an associated tensioning device. Second sensor units are provided in the area between the tensioning device and the associated stitch formation site for sending signals in the case of thread disturbance. A monitoring switching arrangement is provided, evaluating signals from the sensor units differently to induce different switching processes, either alerting the operator or stopping the sewing process, after a predetermined time or immediately.

15 Claims, 3 Drawing Sheets

SEWING MACHINE THREAD MONITORING SYSTEM

FIELD OF THE INVENTION

The present invention pertains to a thread monitor for monitoring the thread on a stitch-forming machines wherein the thread may always be fed to a sorted stitch-forming element from an endless thread reserve.

BACKGROUND OF THE INVENTION

In sewing machines, the needle thread is monitored, in general, between the endless thread reserve and the needle. The looper thread is monitored between the endless thread reserve and the shuttle in the case of multiple-thread chain stitch sewing machines, and between the shuttle and the stitch formation site in the case of double lockstitch sewing machines. After a thread disturbance appears, the thread monitor sends a signal eliciting a response from the machine.

For example, a thread monitor for monitoring the needle thread is disclosed in West German Utility Patent No. 69,13,073. To achieve this, a disk, which is set into rotation by the needle thread being pulled off from the thread reserve and is interrupted by radially extending slots in its edge zone, is monitored by a sensor device. As soon as one of the slots is flush with the sensor device, an impulse is sent to an electronic switch of a control circuit. When the disk stops after breaking of the needle thread and no more impulses are sent to the electronic switch, the sewing machine is stopped.

A thread monitor, whose sensor device, which serves to monitor the needle thread, is held on a holder fastened on the head of the sewing machine, is disclosed in U.S. Pat. No. 4,754,722.

The needle thread is led through the monitoring zone of the sensor device to the needle. As a consequence of the upward and downward movements of the needle bar during sewing, the needle thread is swung out of its middle position alternatingly in opposite directions, so that it performs an oscillating motion at right angles to the direction of thread pull and it traverses the monitored zone of the sensor device once per stitch, oscillating to and fro. Disappearance of this thread movement is indicated as a disturbance.

SUMMARY AND OBJECTS OF THE INVENTION

The basic object of the invention is to design a thread monitor for a stitch-forming machine such that it monitors the thread along its path at a plurality of points, and in the case of a thread disturbance, it controls the machine such that a switching process corresponding to the site of disturbance is induced on the machine, depending on the site of disturbance.

According to the invention, a thread monitoring arrangement for monitoring the thread on stitch-forming machines, wherein the thread may always be fed over a tensioning device to the associated stitch-forming element from an endless thread reserve.

According to the invention, a thread monitoring arrangement for monitoring the thread on stitch-forming machines, wherein the thread can always be fed over a tensioning device to the associated stitch-forming element from an endless thread reserve is provided including a thread monitor having first sensor units positioned between the thread reserve and the respective associated tensioning device. Second sensor units are provided positioned between each of the tensioning devices and the respective stitch-forming element associated therewith. Upon a thread disturbance occurrence, the sensor units send signals that can be evaluated differently to induce different switching processes. This function is provided by monitoring means for evaluating signals from each of the sensor units differently and issuing a switching signal depending upon the signal received.

For example, on multiple-thread chain stitch sewing machines, the needle thread and the looper thread are monitored by the first sensor unit immediately after being pulled off from the endless thread reserve. Due to this measure, early detection of the thread end is possible, because a relatively long thread remnant remains between the sensor unit and the tensioning device associated with the thread. Thus, after indication of the thread end or a thread break, it is still possible to finish the seam in the size predetermined by the stitch length with the necessary thread tension, without thread replacement.

In the case of the needle thread, the greatest risk of break occurs in the area between the tensioning device and the needle, because it is stressed more heavily there. The thread remnant now formed, extending to the needle, is not tensioned, so that the stitch formation is interrupted. To indicate this, the second sensor unit is provided behind the tensioning device in order to monitor the needle thread in the direction of thread pull.

In the case of multiple-thread chain stitch sewing machines, the risk to the looper thread is highest between the tensioning device and the looper. Therefore, this area is also equipped with the second sensor unit.

If a plurality of sensor units monitoring the needle thread and/or the looper thread are used at different points of the sewing machine, it is advantageous to evaluate the signals of each sensor unit individually in order to operate the sewing machine at all times such that the damage caused by the thread disturbance will be minimal.

If the thread disturbance occurs, e.g., in the area of the first sensor unit, a measure according to the invention provides that the signals of the first sensor units are used to issue a signal for stopping the machine after a predeterminable thread length has been used up. This is advantageous, because smaller seams can also be completed without thread change. To obtain a reproducible, relatively accurately adjustable, processable thread length, the measure according to the invention provides that the thread length may be predetermined by entering a stitch number into the machines monitoring means wherein the stitch number corresponds to the thread length which is to be used up. The invention provides that the stitch number can be changed automatically by the monitoring means, this depending on the stitch length set, such that the processable thread length must always be constant.

If the thread disturbance occurs in the area of the second sensor unit, the machine is operated, according to the invention, to provide that the machine, via the monitoring means can be stopped immediately by the signals sent by the second sensor units.

The invention provides that both sensor units are connected to a control device that evaluates the signals differently. This provides a means for realizing a different evaluation of the signals in a technically simple manner.

The measure according to the invention in which each sensor unit is arranged in an area of a thread guiding member causes the thread always to be monitored in areas in which it is already guided in the manner most favorable for monitoring. Such areas include:

providing a first sensor unit arranged on a holder of the thread reserve post in the area of an eye, providing a sensor unit fastened on a strap fastened on the sewing machine head in the area between the thread lever and the needle and for a multiple-thread change stitch sewing machine, and providing a sensor unit arranged in an area of a strap fastened on a lower side of a base plate of the sewing machine, in front of a looper, in the direction of thread pull.

For a double lock stitch sewing machine, a sensor unit will be provided monitoring the bobbin thread such that this sensor unit and the other sensor units, including the first and second sensor units, are connected to a common control device such that the sensor unit monitoring the bobbin thread of a double lockstitch sewing machine can be coupled with the thread monitor or monitoring means.

The thread can be dynamically monitored due to the thread movement usual in sewing machines in that monitoring may be accomplished as the thread moves at right angles to the direction of thread pull incidence with the stitch formation. When traversing the action zone of a sensor unit, the thread reduces the signal, which would otherwise arrive uniformly at the receiver, in an impulse-like manner. This signal reduction is evaluated as a function of the stitch formation. To achieve this, for example, a position transducer, which is connected to the control device and monitors the rotation of the main shaft, is provided, which predetermines, depending on the speed of the sewing machine, the checking interval within which the signal reduction must occur. If the checking interval ends without signal reduction, this indicates that no thread has traversed the action zone of the sensor unit, due to thread end or break.

The invention includes accommodating the sensor units centrally between the two reversal points of the thread oscillating in the transverse direction. The size of their action zone being such that the thread swings out of this action zone alternatingly in opposite directions in the trouble free state thus (oscillates back and forth in accordance with stitch formation) providing the possibility of positioning the sensor units relative to the thread for dynamic monitoring of the thread. This design is also suitable for indicating missed stitches. The transverse movements of the thread are considerably reduced in this case because of the reduced thread pull, so that the thread does not swing out of the action zone of the sensor unit. As a result, the signal reduction is uninterrupted during the checking interval predetermined by the position transducer.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
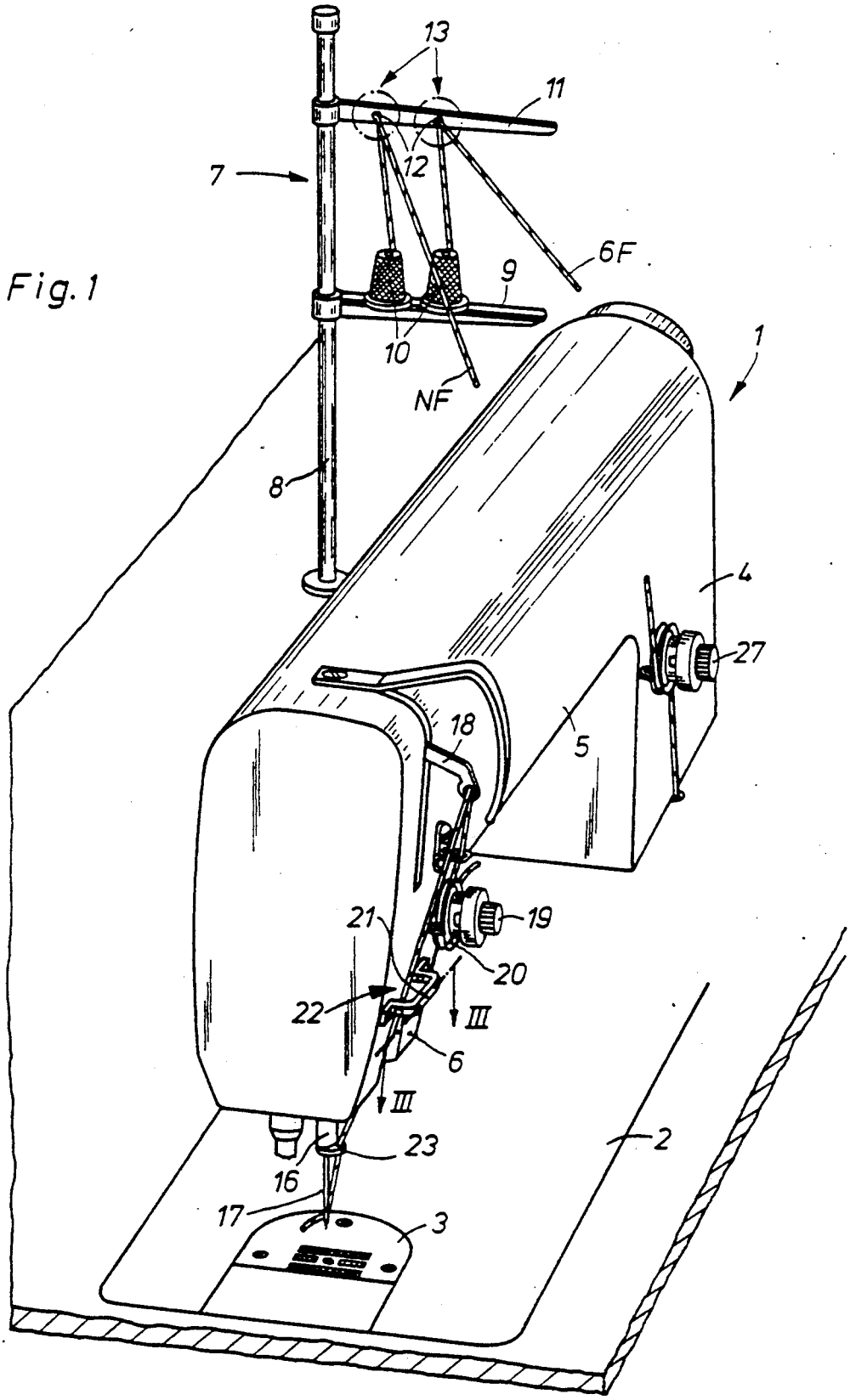
FIG. 1 is a perspective view of a sewing machine.

A thread reserve post 7, on whose vertical post bar 8 a thread reserve support 9 for receiving the thread reserve 10 is fastened, is arranged on the rear side of a multiple thread chain stitch sewing machine shown in FIG. 1. The sewing machine housing 1 consists of a base plate 2 with a needle plate 3, a stand 4, an arm 5, and a head 6. A holder 11, fastened to the post bar 8 carrying eyes 12 for guiding the thread, extends above the thread reserve 10.

Figure 2:
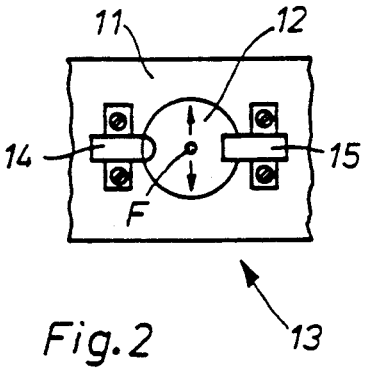
FIG. 2 is an enlarged representation of a first sensor unit, which is circled in dash-dotted line in FIG. 1.

A sensor unit 13, which is shown on a larger scale in FIG. 2, is accommodated on each eye 12. The sensor unit 13 has a photodiode 14 acting as a transmitter and a photodetector 15 acting as the receiver. The thread F (needle thread or shuttle thread) can be moved in the directions shown through the zone of the photocell directed from the photodiode 14 to the photodetector 15.

A tensioning device 19 with a thread pulling spring 20 and a strap 21 is fastened on the side of the head 6 is on the right in FIG. 1. In the head 6 a needle bar 16 for receiving the needle 17 and a thread lever 18 is mounted and driven.

Figure 3:
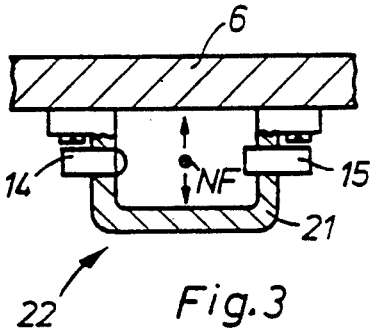
FIG. 3 is an enlarged representation of a second sensor unit along line III—III in FIG. 1.

A sensor unit 22 (FIG. 3), whose design corresponds to a photodiode and a photodetector of the sensor unit 13, is accommodated on the strap 21. The needle thread NF can be moved as shown in the zone of the sensor unit 22 at right angles to the head 6.

The needle thread (FIG. 1) pulled from the thread reserve 10 is fed to the needle 17 via thread guides (not shown. The tensioning device 19, the thread lever 18, the strap 21, and a thread eye 23 are provided on the needle bar 16.

Figure 4:
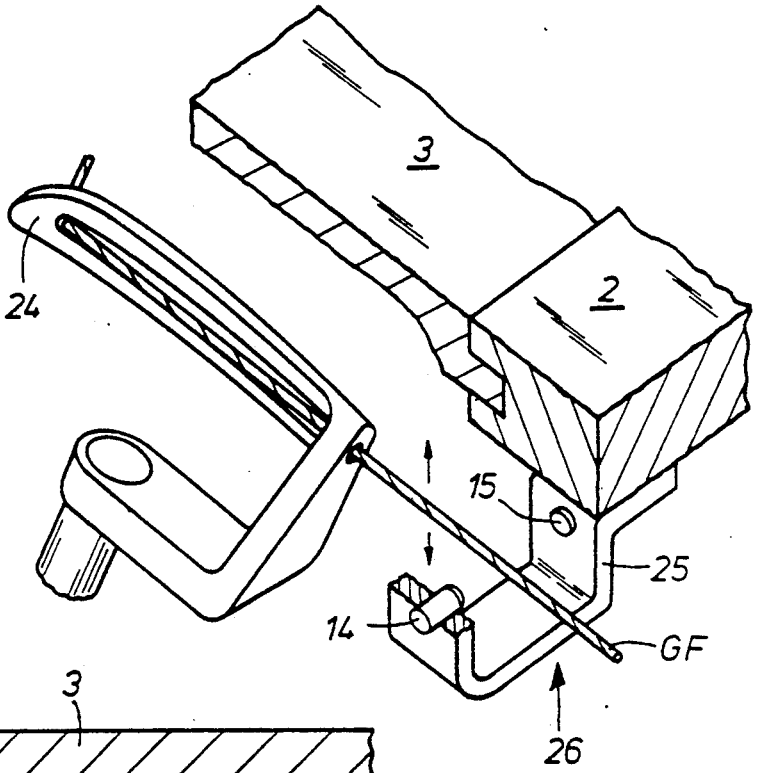
FIG. 4 is a sensor unit under the needle plate.

The looper 24 (FIG. 4) mounted under the needle plate 3 has, on its rear side, a strap 25 fastened to the base plate 2 for guiding the thread. A sensor unit 26, whose design is the same as that of the sensor units 13 and 22, is accommodated on the strap 25. The looper thread GF oscillates in the zone of the sensor unit 26 at right angles to the base plate 2.

The looper thread pulled off from the thread reserve 10 (FIG. 1) passes through the associated eye 12, a tensioning device 27 arranged on the post 4, and a plurality of thread guides (not shown), and reaches the looper 24 via the strap 25.

Figure 5:
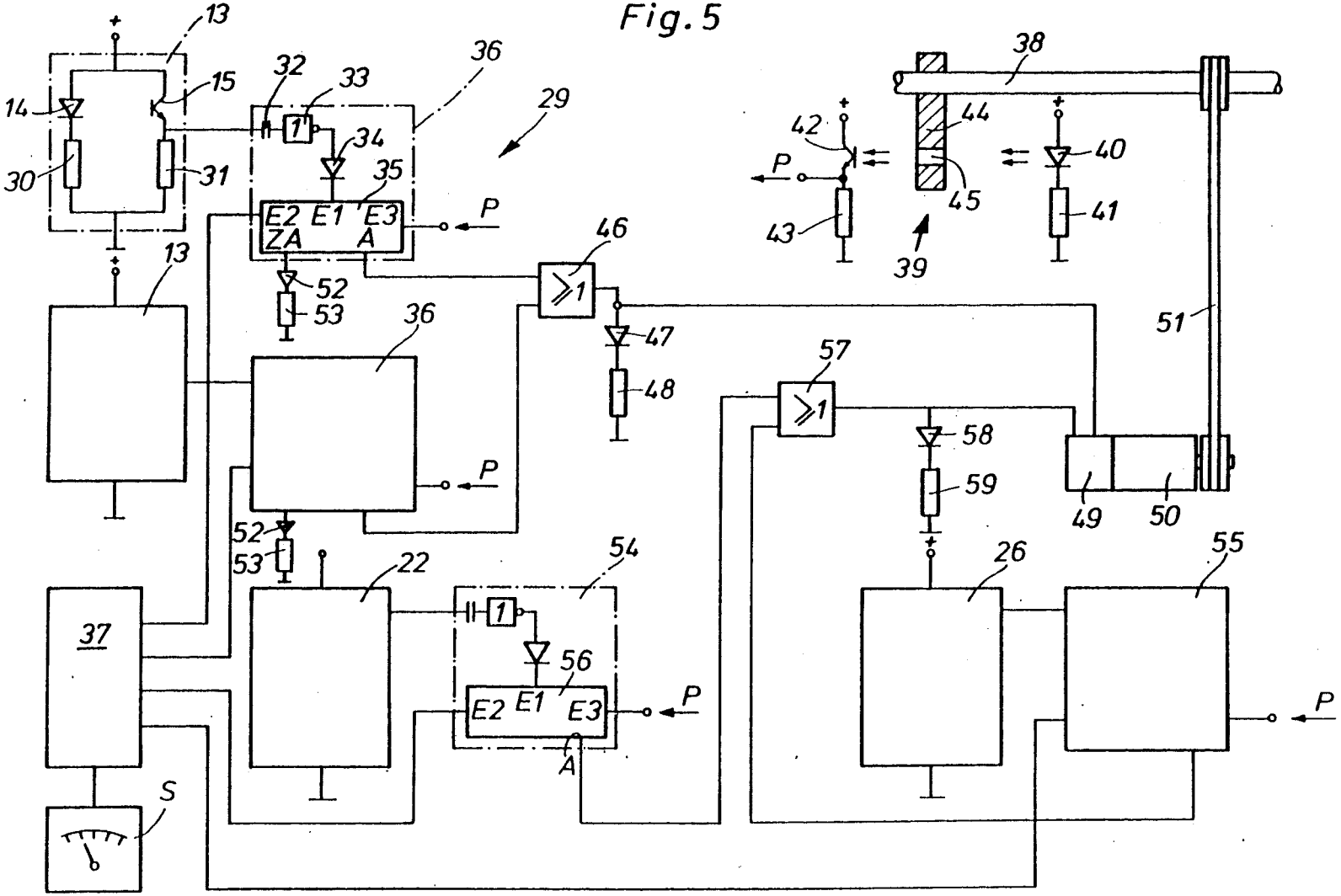
FIG. 5 is a simplified circuit diagram of a control device.

The sensor units 13, 22 and 26 together form a thread monitor 28 and are connected to a control device 29 shown in FIG. 5.

The elements needed for the operation of the control device 29 are shown in a simplified circuit diagram in FIG. 5. The control device 29 permits dynamic thread monitoring.

Each of the two sensor units 13 has a stabilized power source, from the positive pole of which current flows through the photodiode 14 and a resistor 30 to ground. Current also flows from the positive pole of the power source to ground through the photodetector 15, designed as a phototransistor, and a resistor 31.

The emitters of the photodetectors 15 are each connected to a capacitor 32, which is used to filter out direct current caused by daylight and the alternating current caused by low-frequency sewing light. The output of the capacitor 32 is connected to an input E1 of a counter 35 via a NOT or invertor element 33 and an amplifier 34. Together with the elements 32 through 34, the counter 35 forms a counting device 36.

To set the counter 35, a signal corresponding to the necessary maximum can be sent to it via an input E2. The maximum can be preselected on a control panel 37, to which the input E2 is connected. The maximum preselected on the control panel 37 corresponds, e.g., to a number of stitches that are to be prepared by the sewing machine after a thread disturbarce. A thread length that can be processed until the sewing machine stops, which can also have zero value, is predetermined by the stitch number. The sewing machine is designed such that when the stitch numbers are greater than zero, a change in the stitch length on a stitch length regulating mechanism S, which is known and is therefore shown only schematically, causes a signal associated with the stitch length to be sent to the control panel 37. The control panel 37 now automatically adjusts the stitch number to the new stitch length, so that the processable thread length remains constant.

A position transducer 39 monitoring the revolutions of the main shaft 38 is connected to an input E3 of the counter 35. This position transducer 39 has a photodiode 40 connected to a stabilized power source which is grounded through a resistor 41, it also has a photodetector 42, designed as a phototransistor, which is also connected to the positive pole and is grounded through a resistor 43. A disk 44, arranged non-rotatably on the main shaft 38, is provided with a plurality of openings 45 for the passage of light beams, and is arranged in the light path between the photodiode 40 and the photodetector 42. One impulse P is sent to the input E3 of the counter 35 on each passage.

The outputs A of the counter 35 are connected via an OR element 46 to a display element 47, which is grounded through a resistor 48. The output A is also connected to a shutoff device 49 of the drive motor 50 of the sewing machine. The drive motor 50 drives the main shaft 38 via a V-belt 51.

One display element 52, which is grounded through a resistor 53, is connected to each of the auxiliary inputs ZA of the counters 35.

The sensor unit 22 is connected to a counting device 54, and the sensor unit 26 is connected to a counting device 55. The designs of the counting devices 54 and 55 correspond to that of the counting device 36 described, but their counters 56 have no auxiliary output ZA, unlike that of the counting device 36.

The counting devices 54 and 55 are connected via their counter outputs A to an OR element 57, whose output is connected to a display element 58. The display element 58 is grounded through a resistor 59. The shutoff device 49 of the drive motor 50 is also connected to the output of the OR element 57.

The thread monitor operates as follows:

Due to the cyclic succession of tensioning and loosening of the needle thread and the looper thread in cadence with the thread pull, the threads are induced to oscillate at right angles to the direction of thread pull.

The sensor units 13 at the thread reserve post 7 are now traversed by the needle thread and the looper thread in the upward and downward directions during each stitch as long as no thread end or break between the thread reserve 10 and the eyes 12 occurs.

The light signal entering the photodetector 15 of each sensor unit 13 is interrupted during each of these passages. As a result, the otherwise conductive photodetector 15 is briefly blocked, and no current flows to the input of the NOT element 33, so that its output sends a signal with "high" potential, hereinafter called signal H. Signal H is sent via the amplifier 34 to the input E1 of the counter 35. The counter 35 is reset to its starting position, the zero value, by the signal H.

As a result, the counter 35 now begins to add up the impulses arriving at the input E3 from the position transducer 39; a predetermined number of signals corresponds to one revolution of the main shaft 38. As long as threads run through both eyes 12 of the thread spool post 7, the counter 35 is always reset to zero before reaching the maximum set on the control panel 37 and entered via the input E2.

If the signals H disappear as a consequence of break or end of the needle thread or looper thread, the corresponding counter 35 counts up to the maximum and sends from its output A a signal H via the OR element 46 to the display element 47 and to the shutoff device 49. As a result, the display element 47 is switched on, and the shutoff device 49 is actuated such that it prevents the drive motor 50 from being restarted after the next stopping.

The sensor units 13 are provided for additionally detecting missed stitches. Since only a little needle thread or looper thread is pulled off during a missed stitch, the oscillation induced in the transverse direction is very small, so that the thread in question does not leave the action zone of the associated sensor unit 13. As a result, the input of the NOT element 33 always carries a low signal L, and its output, as well as the input E1 of the counter 35 carry a signal H, which prevents the counter 35 from counting up. At the same time, the impulses of the position transducer 39 arriving at the counter input E3 are counted in a second counter part. If the number of impulses corresponding to one full revolution of the main shaft 38 is reached without interruption of the signal H carried by the counter input El, the counting device 36 sends from its auxiliary output ZA a signal for turning on the display element 52.

The light path of the sensor unit 22 is interrupted by the needle thread oscillating to and fro at right angles to the head 6 twice per stitch. The signals of the sensor unit 22 are transmitted to the counting device 54, in which they are evaluated, to detect a thread break occurring behind the tensioning device 19, in the same way as the signal sent to the above-described counting device 36. After appearance of a thread break, the counting device 54 sends from its counter output A a signal H which, after passing through the OR element 57, turns on the display element 58 and actuates the shutoff device 49 to immediately shut off the drive motor 50.

The sensor unit 26 at the strap 25 is traversed by the looper thread once in the upward direction and once in the downward direction during each stitch. The resulting brief interruption of the signal reaching the photodetector 15 serves to reset the counter of the counting device 55 to the initial value of zero. This resetting takes place in the manner described in connection with the counting device 36.

In case of break of the looper thread behind the tensioning device 27, its thread end is led to the looper 24 without tension, so that the looper thread no longer traverses the photocell of the sensor unit 26 cyclically. As a result, a signal H is sent from the counter output A of the counting device 55, and this signal turns on the display element 58 and at the same time activates the shutoff device 49 to immediately stop the drive motor 50.

Figure 6:
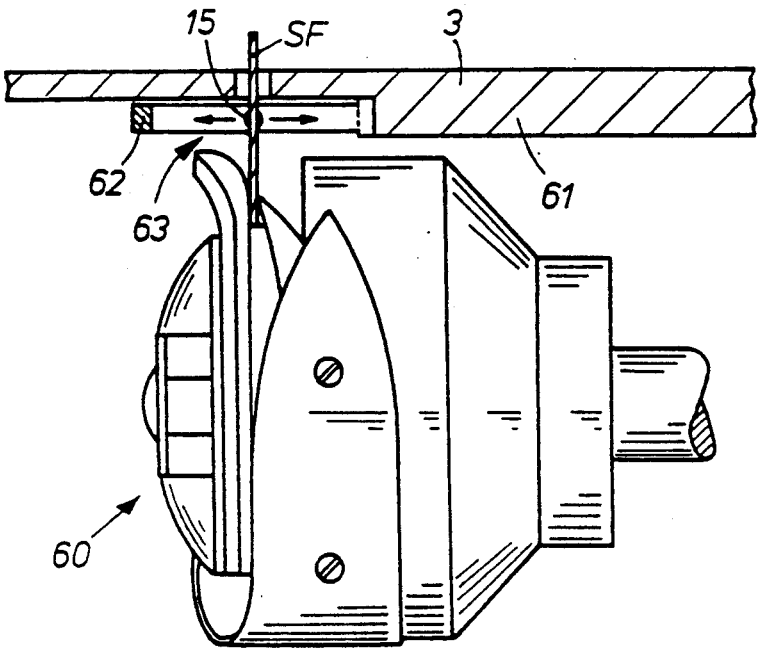
FIG. 6 is another example of the use of a sensor unit under the needle plate.

As is shown in FIG. 6, the bobbin thread SF on double lockstitch sewing machines is led along the front side of the shuttle 60 and is deflected by it during the rotary movement in a direction in parallel to the shuttle axis. A strap 62, on which a sensor unit 63, whose design is identical to that of the sensor units 12, 22 and 26, is accommodated, is fastened to a support block 61 on the lower side of the needle plate 3. The photocell of the sensor unit 63 extends in parallel to the lower side of the needle plate and at right angles to the transverse direction of oscillation of the bobbin thread shown. To evaluate the signals, the sensor unit 63 rather than the sensor unit 26 is connected to the counting device 55 of the control device 29.

Vibrating to and fro once during each revolution of the shuttle 60, the bobbin thread passes through the action zone of the sensor unit 63 during trouble-free thread pull. The interruptions that thus occur in the photocell directed toward the photodetector 15 are evaluated by the counting device 55 in the above-described manner.

While specific embodiments of the invention have been shown and described in detail to illustrate the application of the principles of the invention, it will be understood that the invention may be embodied otherwise without departing from such principles.

I claim:

1. A thread monitoring arrangement for monitoring thread on a stitch-forming machine, the thread passing through a tensioning device to an associated stitch-forming element from an endless thread reserve, the thread monitoring arrangement comprising:

first sensor means for sensing a presence of the thread, said first sensor means positioned adjacent a point on the thread path between the thread reserve and a respective associated tensioning device; second sensor means for sensing presence of the same thread at a different location, said second sensor means positioned adjacent a point on the thread path between the tensioning device and a respective stitch-forming element associated therewith; shutoff means for stopping a drive motor of the stitch forming machine; and, monitoring means for receiving signals from said first and second sensor means which sense a thread disturbance, said monitoring means providing a switching signal to said shutoff means dependent upon the origin of the signal received from said first and second sensor means to stop the drive motor of the stitch forming machine.

2. A thread monitoring arrangement according to claim 1, wherein:

said monitoring means issues a signal to stop the stitch-forming machine when a predeterminable thread length has been used up, after receiving a signal from said first sensor means.

3. A thread monitoring arrangement according to claim 2, wherein said predeterminable thread length may be set by entering a stitch number into the monitoring means, corresponding to the thread length which is to be used up.

4. A thread monitoring arrangement according to claim 2, wherein said monitoring means includes means for changing said stitch number automatically depending upon the stitch length set.

5. A thread monitoring arrangement according to claim 1, wherein said monitoring means issues a signal for stopping the machine immediately upon receiving a thread disturbance signal from said second sensor means.

6. A thread monitoring means according to claim 1, wherein said monitoring means includes a control unit for receiving signals from said sensor means and outputting a signal based on the signal received.

7. A thread monitoring arrangement according to claim 1, wherein each of said sensor means is arranged in the area of a thread guiding member.

8. A thread monitoring arrangement according to claim 1, wherein one of said sensor means is arranged on a thread reserve post in the area of an eye on the holder.

9. A thread monitoring arrangement according to claim 1, wherein one of said sensor means is fastened on a strap fastened on a sewing machine head in an area between a thread lever and a sewing machine needle.

10. A thread monitoring arrangement according to claim 1, wherein the stitch-forming machine is a multiple-thread chain stitch sewing machine, including a sensor means arranged so that it is supported by a strap fastened to a lower side of a base plate of the stitch-forming machine in front of a lopper.

11. A thread monitoring arrangement according to claim 1, wherein the stitch-forming machine is a double lockstitch sewing machine including a monitoring means for monitoring a bobbin thread, said first and second sensor means are each connected to said monitoring means.

12. A thread monitoring arrangement according to claim 1, wherein the thread moves at right angles to a direction of thread pull in cadence with stitch formation, said sensor means being arranged in areas of relatively great transverse movement of the thread such that the thread oscillates through an action zone of each said sensor means at least once per each stitch formation cycle, generating a signal representing the presence of the thread and the lack of a thread disturbance.

13. A thread monitoring arrangement according to claim 1, wherein each of said sensor means is accommodated centrally between two reversal points of the thread oscillating in the transverse direction, each action zone being sized such that the thread swings out of the action zone alternatingly in opposite directions in a trouble-free state.

14. A thread monitoring arrangement for a stitch-forming machine, the arrangement comprising: a thread reserve and a respective associated tensioning device first thread sensor for sensing a presence of a first thread at a first location, said first sensor means positioned adjacent a point on the thread path between said thread reserve and said respective associated tensioning device;

second first thread sensor positioned at a second location for sensing a presence of said first thread at said second location;

first another thread sensor positioned at another first location for sensing a presence of another thread at said another first location;

second another thread sensor positioned at another second location for sensing a presence of said another thread at said another second location; and monitoring means for receiving signals from said sensors and said monitoring means providing a switching signal depending upon the origin of the signal received.

15. A thread monitoring arrangement according to claim 14, further comprising: shut off means for stopping a drive motor of the stitch-forming machine in response to said switching signal.

* * * * *